United States Patent [19]

Hague

[11] 4,299,106

[45] Nov. 10, 1981

[54] FINNED TUBING

[75] Inventor: Donald Hague, Germiston, South Africa

[73] Assignee: Heat Exchangers Africa Limited, Johannesburg, South Africa

[21] Appl. No.: 18,219

[22] Filed: Mar. 7, 1979

[30] Foreign Application Priority Data

Sep. 22, 1978 [ZA] South Africa ..... 78/5390

[51] Int. Cl.[3] ..... B21H 3/12

[52] U.S. Cl. ..... 72/78; 72/98; 165/184

[58] Field of Search ..... 72/68, 79, 98, 103, 72/78; 29/157.3 A, 157.3 AH, 157.3 B; 165/181, 183, 184

[56] References Cited

U.S. PATENT DOCUMENTS

| | | | |
|---|---|---|---|
| 1,984,938 | 12/1934 | Mason et al. | 165/181 X |
| 2,337,490 | 12/1943 | Penner | 29/157.3 AH |
| 2,958,121 | 11/1960 | Toscher | 29/614 |
| 3,327,512 | 6/1967 | Novak et al. | 72/100 X |
| 3,383,892 | 5/1968 | Brothen | 29/157.3 AH |
| 3,602,027 | 8/1971 | Klug et al. | 29/157.3 AH |
| 3,648,502 | 3/1972 | Klug et al. | 29/157.3 AH |
| 3,745,801 | 7/1973 | Kallfelz | 72/78 |
| 3,878,593 | 4/1975 | Owens | 29/157.3 A |
| 4,100,784 | 7/1978 | Thomas | 29/157.3 AH |
| 4,168,618 | 9/1979 | Saier et al. | 72/79 X |

FOREIGN PATENT DOCUMENTS

| | | | |
|---|---|---|---|
| 111528 | 9/1940 | Australia | 165/184 |

*Primary Examiner*—Lowell A. Larson

*Attorney, Agent, or Firm*—Ladas & Parry

[57] ABSTRACT

The invention provides for a method of and an apparatus for manufacturing finned tubing from tubular metal fin stock in which the fin stock is in axially continuous form. There are provided at least two finned regions on the fin stock between which there is interposed at least one finless region. A plurality of rollers are employed which are drivably mounted on arbors spaced about the fin stock. Each roller includes a plurality of axially arranged forming discs, the discs on the arbors tracking each other in axially spaced groups, and the diameters of the forming discs in each tracking group on the arbors having different diameters. The fin in a finned region is developed to its full height over an axial distance of the fin stock equal to from 0.40 to 0.75 of the outside diameter of the fully developed fin.

26 Claims, 12 Drawing Figures

FINNED TUBING

BACKGROUND TO THE INVENTION

This invention relates to finned tubing. The invention relates in particular to a method of manufacturing finned tubing from tubular metal fin stock, to apparatus for manufacturing finned tubing and to finned tubing manufactured in accordance with the method.

More specifically the invention relates to the manufacture of finned tubing by employing a plurality of rollers drivably mounted on arbors spaced about the tubular fin stock. Each of the rollers includes a plurality of axially arranged forming discs, the arrangement being such that the discs on the respective rollers track with each other. The discs can be brought into rolling contact with the fin stock and when this is done and the arbors are driven, the discs penetrate into the fin stock and deform the stock so that the metal in the fin stock is forced into axial spaces between the forming discs to thereby form fins on the fin stock. The axes of the arbors intersect the axis of the fin stock so that when the arbors are driven the forming discs traverse the fin stock longitudinally and thereby extrude helical fins from the fin stock.

According to the invention there is provided a method of manufacturing finned tubing from tubular metal fin stock which includes providing the fin stock in axially continuous form and providing on the fin stock at least two finned regions and at least one finless region interposed between two finned regions.

The metal fin stock may be provided in one piece or it may be in separate parts which are secured to each other so as to be axially continuous. The securing together may for example be by welding.

The method may include forming the tubing in linear form with the finned and the finless regions longitudinally spaced from each other.

The method may further include employing a plurality of rollers drivably mounted on arbors spaced about the tubular fin stock, each of the rollers including a plurality of axially arranged forming discs which can be brought into rolling contact with the fin stock and the rotational axis of each arbor intersecting the longitudinal axis of the fin stock.

Still further the method may include intermittently engaging the forming discs with the tubular metal fin stock and disengaging the forming discs from the fin stock. This arrangement may include engaging the forming discs with the fin stock to thereby form fins and thus a finned region in the fin stock, disengaging the forming discs from the fin stock, axially advancing the metal fin stock so that a finless region is provided on the fin stock, and reengaging the forming discs with the fin stock to again form fins and thus a finned region axially spaced from the first finned region by the finless region.

The fin in the finned region may be developed to its full height over an axial distance of the fin stock equal to from 0:40 to 0:75 of the outside diameter of the fully developed fin, and more specifically over an axial distance of the fin stock equal to from 0:50 to 0:60 of the outside diameter of the fully developed fin.

The method may further include effecting relative rotation in one direction of the discs with respect to the tubular fin stock, bringing the discs into rolling contact with the tubular fin stock at a position intermediate the ends of the fin stock and developing a helical fin extending over a finite axial distance of the fin stock, arresting the rotation of the discs and reversing the direction of rotation of the forming discs so that the axial displacement of the fin is thereby reversed. This method may include maintaining the reverse axial displacement of the fin stock until the axial starting point of the fin generation is reached and then continuing the rotation of the forming discs and the axial displacement of the fin stock past the starting point, and generating the fin over a finite axial distance of the fin stock extending beyond the starting point.

Conveniently, the method may include controlling the bringing of the forming discs into rolling contact with the tubular fin stock during oscillating reversal of the direction of rotation of the forming discs.

One method of control may include closing the arbors continuously on the fin stock during oscillating reversal of direction of rotation of the forming discs.

Another method of control may include closing the arbors in stages on the fin stock during oscillating reversal of rotation of the forming discs.

The reversing of the direction of rotation of the forming discs may be effected substantially instantaneously.

Relative rotation between the forming discs and the fin stock may be effected by drivingly rotating the forming discs and imparting contra-rotation to the fin stock due to frictional engagement of the discs with the fin stock.

The forming of the finned regions may be started approximately in the axial central region of the fin stock and further finned regions may then be formed from the central region outwardly towards the end regions of the tube.

The forming discs on the different arbors conveniently track each other and engage the fin to a different extent to facilitate rapid development of the fin to its full height. One forming disc on one arbor may engages one third of the height of the fin, the tracking forming disc on a second arbor may engage a further third of the height of a fin, and a tracking forming disc on a third arbor may engage the final third of the height of the fin.

The method may particularly include bringing the forming discs into rolling contact with the fin stock by closing the forming discs around the fin stock by moving them in a radial direction towards the fin stock, forming an axial length of fin by rotation of the forming discs, arresting the rotation of the discs to terminate the fin, reversing the direction of rotation of the forming discs substantially instantaneously to thereby displace the fin in an opposite axial direction, and when the forming discs reach the axial starting point of the formation of the fin, closing the forming discs around the fin stock to thereby develop the fin in an axially opposite direction from the starting direction.

The axial transition from the finned to the under developed finned region may be effected by oscillatingly reversing the rotation of the discs a few revolutions.

The fin formation may be continued for a desired axial length and the discs may then be released from the fin stock to thereby terminate the fin.

The rotational axes of the arbors may intersect the axis of the fin stock at different angles.

The method may further include crushing an axial region of under developed fins blending from a region of fully developed fins to a finless region so that thereby an abrupt transition is made from a region of fully developed fins to a finless region. The under developed fins may be crushed to have a cross-sectional dimension which is uniform with and which blends into the finless region.

An alternative method may include forming at least a part of the finless region by machining away fins from a finned region. The finned tubing may be bi-metal comprising a tubular metal fin stock on a tubular metal liner.

Further according to the invention there is provided apparatus for manufacturing finned tubing from tubular metal fin stock in which the tubing has finned and finless regions, the apparatus including three rotatably drivable arbors, a plurality of axially arranged forming discs mounted on each arbor to be rotatably drivable by the arbors, the forming discs on the arbors being arranged to track each other in axially spaced groups, and the diameters of the forming discs in each tracking group on the arbors having different diameters.

The diameters of the tracking forming discs in each tracking group may vary in the proportion 1 to 1:1 to 1:2.

The axis of each arbor may intersect the longitudinal axis of the fin stock, and the rotational axes of the arbors may intersect the longitudinal axis of the fin stock at different angles.

The angle of intersection between the rotational axis of each arbor and the longitudinal axis of the fin stock may be between 3 degrees and 7 degrees. Specifically, the angles of intersection between the rotational axes of the arbors and the longitudinal axis of the fin stock may be 3 degrees for one arbor, 4 degrees for another arbor and 6 degrees for the third arbor.

The set of forming discs on each arbor may include discs of different diameters. The axial length of the set of forming discs on each arbor may be shorter than the overall diameter of the largest discs in each set. The overall diameter of the largest discs on each arbor to the length of the set of discs is in the ratio of from 2:2 to 1 to 2:6 to 1.

The forming discs on each arbor may be provided in three axial regions, a first axial region including discs of different diameters with the axially extending profile of the discs tapering axially, a second axial region similar to the first axial region including discs of different diameters but with the axially extending profile of the discs tapering axially in an opposite direction, and a third axial region of discs of equal diameter interposed between the first and the second axial regions. The first and the second axial regions may each include four forming discs and the third axial region may include six forming discs.

The axial spacing between the forming discs in the axially tapering first and second regions may be different from the axial spacing between the forming discs in the third axial region.

Conveniently, the direction of rotation of the arbors may be reversible.

Still further according to the invention there is provided finned tubing formed from continuous tubular metal finned stock which includes at least two finned regions and at least one finless region interposed between the finned regions. At least one finned region may include an axial region in which the fin is only partly developed, and an axial region in which the fin is fully developed, the axial length of the under developed finned region being from 0:50 to 0:60 of the diameter of the fully developed fin.

Finned tubing according to the invention may be bi-metal including tubular metal fin stock on a tubular metal liner.

The invention further extends to bi-metal finned tubing whenever manufactured in accordance with the method of the invention.

The invention is now described with reference to the accompanying drawings, in which.

Figure 1:
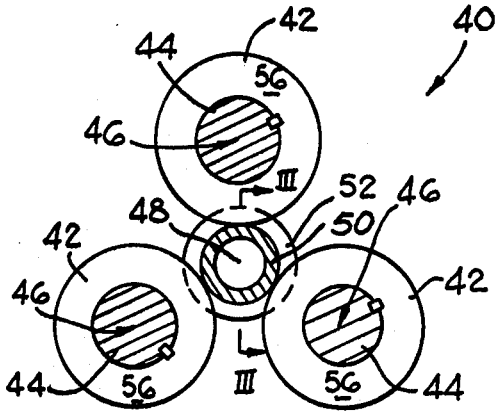
FIG. 1 shows an end view of one embodiment of three fin-forming rollers with a tubular fin stock and a tube liner positioned between them in a fin rolling position.
Figure 3:
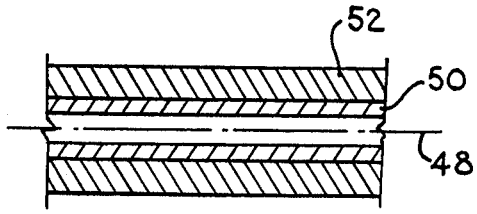
FIG. 3 shows on an enlarged scale a longitudinal sectional view on line III—III of the tubular fin stock and tube liner in FIG. 1.

Referring to FIG. 1, reference numeral 40 indicates a fin rolling apparatus in general. It includes three rollers 42 which are fixedly mounted on arbors 44 having each a rotational axis 46. The arbors 44 are equidistantly spaced about the axis 48 of a tube liner 50 inside a tubular fin stock 52. This is also shown in FIG. 3. The liner 50 may be of stainless steel or carbon steel and the fin stock 52 of aluminium, copper, or a like ductile metal. When the arbors 44 are driven they rotate the rollers 42 and due to frictional rolling contact between the rollers 42 and the fin stock 52, the fin stock is contra-rotated about the axis 48.

Figure 2:
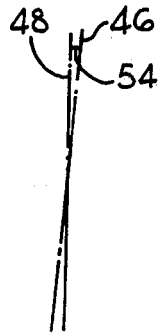
FIG. 2 shows a plan view of the intersection of the rotational axis of one of the rollers shown in FIG. 1 with the axis of the tube liner.

FIG. 2 shows that the axes 46 and 48 of the rollers 42 and the tube liner 48 respectively are off-set with respect to one another by an angle 54.

The rollers 42 include a plurality of forming discs 56 arranged adjacent each other and concentric with the rotational axis 46. The discs on the rollers are arranged to track each other, and due to the off-set angle 54 shown in FIG. 2, a helical fin is rolled into the fin stock 52 during rotation of the arbors 44. The angle 54 determines the pitch of the helical fin.

Figure 4:
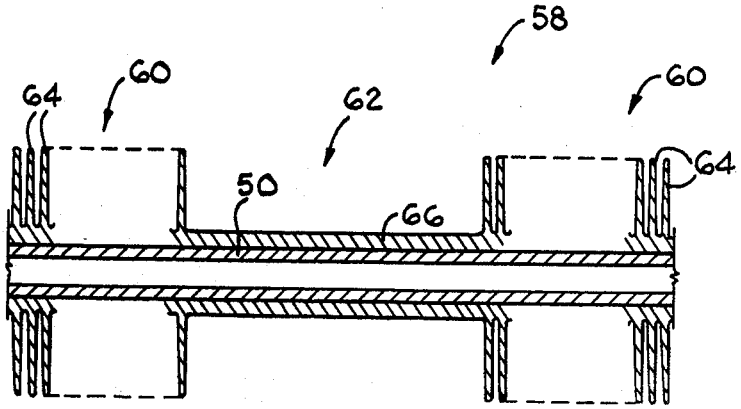
FIG. 4 shows a longitudinal sectional view of finned tubing manufactured in accordance with one method of the invention.

Referring to FIG. 4, there is shown a finned tube 58 in accordance with the invention. It includes finned regions 60 longitudinally spaced from each other and with a finless axial region 62 interposed therebetween. Each finned region 60 includes a plurality of fins 64. The finned tubing 58 is formed from the metal fin stock 52 shown in FIG. 3 and the method of manufacture is as follows:

The rollers 42 including the forming discs 56 are clamped around the fin stock 52 as shown in FIG. 1 and the rollers are rotated. Thereby a helical fin 64 is formed in a manner as described with reference to FIG. 1. The finned tube thus formed is removed from the rollers 42, and the fins in the region 62 are machined away to thereby form a finless region axially interposed between the finned regions 60. Due to the machining away of the fins the residual tubular fin stock in the region 62 is reduced in wall thickness from the original thickness of the tubular fin stock 52 as shown in FIG. 3 to a smaller thickness as indicated by 66.

Figure 5:
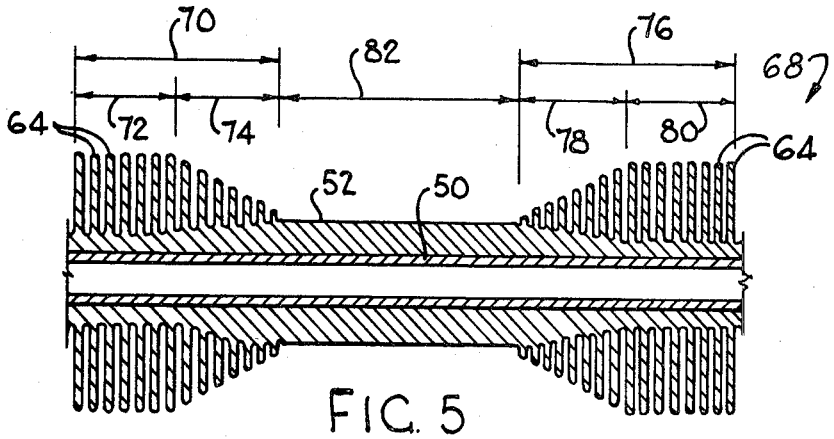
FIG. 5 shows a longitudinal sectional view of finned tubing manufactured in accordance with another method of the invention.

FIG. 5 shows a finned tube 68 manufactured in accordance with an alternative method. In this method the rollers 42 are clamped around the tubular fin stock 52 in the manner described with reference to FIG. 1 and fins are formed along the axial region 70, and the rollers are then released from the fin stock. The result is that fully developed fins 64 are formed over the axial region 72 and imperfectly developed fins are formed over the region 74 while the rollers 42 are being released. The fin stock 52 is then axially advanced and the rollers 42 are again clamped around the fin stock to thereby again form a finned region 76 similar to the finned region 70. The finned region 76 also includes an axial region 78 of imperfectly developed fins while the axial region 80 includes fully developed fins 64. The completed finned tube 68 thus includes axially spaced finned regions 70 and 76 and a finless axial region 82 interposed between the finned regions 70 and 76. As the fin stock 52 in the finless region 82 is intact it retains its original wall thickness and no thinning of the wall takes place as in the finless region 62 in the finned tube 58 of FIG. 4.

Figure 6:
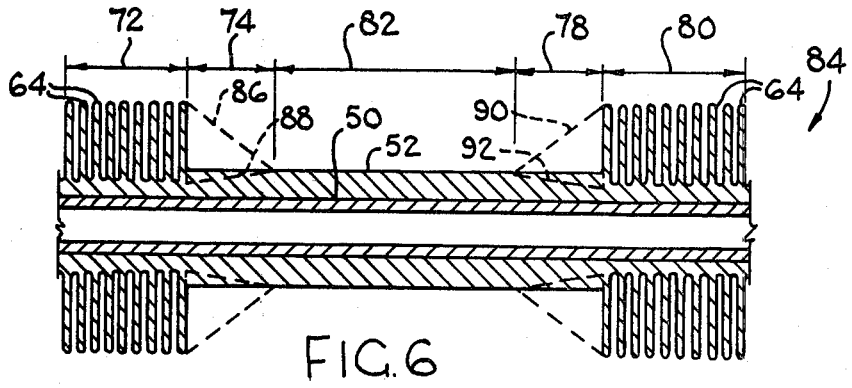
FIG. 6 shows a longitudinal sectional view of a further step in the method of manufacture of the finned tubing shown in FIG. 4.

FIG. 6 shows a further stage of working the finned tube 68 of FIG. 5 so as to finally form a finned tube 84.

The finned tube 84 is formed by crushing the imperfectly developed fins in the axial regions 74 and 78 which had the original crest and root profiles 86 and 88, and 90 and 92, so that the crushed fins have the same profile and cross-sectional dimensions as the fin stock 52. Thus, in the axial profile of the finned tube 84, there is an abrupt radial transition from the fully developed fins 64 in the finned region 72 to the tubular fin stock 52 and back again to the fully developed fins 64 in the finned region 80. This arrangement permits header plates to be fitted over the fin stock 52 to abut fully developed fins 64 in the finned regions 72 and 80, the header plates being not shown.

The crushing of the imperfectly developed fins in the regions 74 and 78 may be effected in a press and may be effected hydraulically or electrically or by means of a cam arrangement (not shown).

In the finned tubing 58 and 84 shown in FIGS. 4 and 6 the fins 64 and the metal fin stock 52 or the residual metal fin stock 66 are integral with each other, while the finned regions 60 and the finless region 62 are also integral with each other, while likewise the finned regions 72 and 80 are integral with the finless region 82.

In an alternative embodiment, not shown, the metal fin stock may be a plain metal tube without a liner instead of being bi-metal as shown in the drawings. In a still further embodiment, also not shown, the finned and the finless regions may be separate from each other and may be rendered integral with each other by, eg welding, so as to be continuous like the fin stock 50 shown in the drawings.

Figure 7:
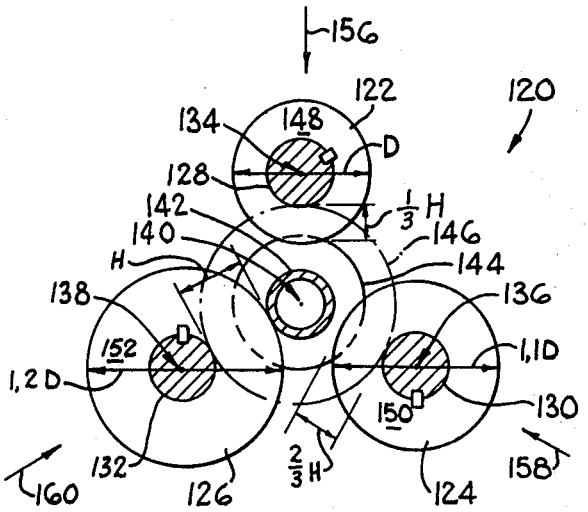
FIG. 7 shows an end view of another embodiment of three fin-forming rollers with a tubular fin stock and a tube liner positioned between them in a fin rolling position.

Referring to FIG. 7, reference numeral 120 indicates another embodiment of a fin rolling apparatus in general. It includes three rollers 122, 124 and 126 which are fixedly mounted on arbors 128, 130 and 132 having each a rotational axis 134, 136 and 138 respectively. The arbors 128, 130 and 132 are equidistantly spaced about the axis 140 of a tube liner 142 inside a tubular fin stock 144. The liner 142 may be of carbon steel or stainless steel and the fin stock 144 of copper or aluminium. When the arbors 128, 130 and 132 are driven they rotate the rollers 122, 124 and 126 and due to frictional rolling contact between the rollers and the fin stock 144, the fin stock is contra rotated about the axis 140. If desired, the fin stock may be rotatably driven by drive means (not shown), with or without reliance on frictional contact drive imparted by the rollers 122, 124 and 126.

Referring further to FIG. 7, reference numeral 146 indicates in dotted lines a fully developed fin which has been developed from the fin stock 144.

Figure 8:
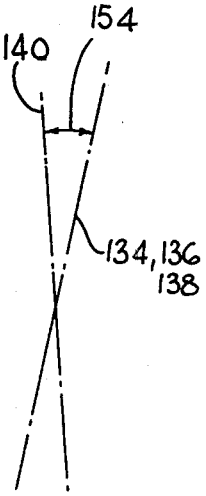
FIG. 8 shows a plan view of the intersection of the rotational axis of one of the rollers shown in FIG. 7 with the axis of the tube liner.

The rollers 122, 124 and 126 each include a plurality of forming discs 148, 150 and 152 respectively which are arranged axially adjacent each other on the arbors 128, 130 and 132 respectively concentric with the rotational axes 134, 136 and 138 respectively. The discs on the rollers are arranged to track each other, and due to the angle 154 with which the rotational axes 134, 136 and 138 intersect the axis 140 of the fin stock 144 as shown in FIG. 8, a helical fin is generated from the fin stock 142 during rotation of the arbors 128, 130 and 132. The angle 154 will be described further with reference to FIG. 8.

Referring still further to FIG. 7, the forming discs 148, 150 and 152 which track each other during the rolling of a fin, have different diameters. Thus, a forming disc 148 of diameter D is tracked by a forming disc 150 of diameter 1.1 D and by a forming disc 152 of diameter 1.2 D. The arrangement is such that with the discs 148, 150 and 152 rotating in a counterclockwise direction and with the fin stock 144 rotating as a result in a clockwise direction, the disc 148 contacts the fin 146 to a depth of one third of the fin height H, the disc 150 contacts the fin 146 by a further one third of the fin height ie a depth of two thirds H, while the disc 152 contacts the fin 146 a further one third of the fin height, ie a total depth of H. The effect of this arrangement is that the tracking rollers 148, 150 and 152 having different diameters, develop the fin 146 very quickly to its full height H.

The arbors 128, 130 and 132 are displaceable towards and away from the fin stock 144 to engage or to be disengaged from the fin stock. In order to engage the fin stock the arbors 128, 130 and 132 are displaced in the directions of arrows 156, 158 and 160 respectively, and in order to disengage the fin stock the arbors are displaced in directions opposite to these arrows.

Referring to FIG. 8, the angle 154 determines the pitch of the helical fin 146 shown in FIG. 7. The angle is different for each of the rotational axes 134, 136 and 138 of the arbors 128, 130 and 132 respectively, and in one specific configuration the angle may be 3 degrees, 4 degrees and 6 degrees respectively. In another configuration the angle may vary from 3 degrees 42 minutes to 6 degrees 12 minutes.

Figure 9:
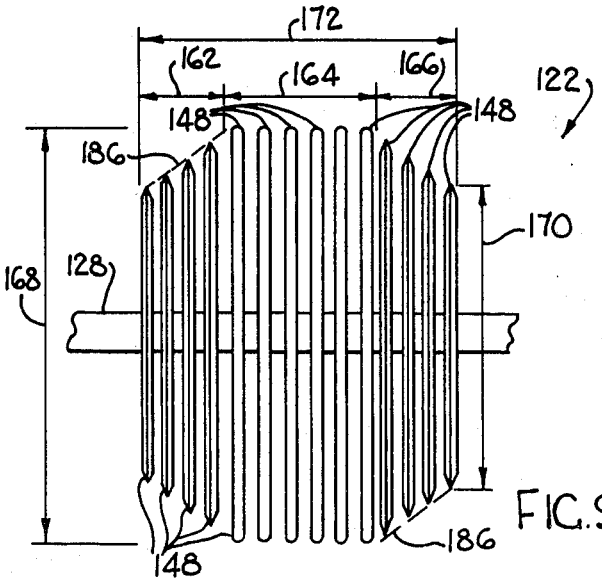
FIG. 9 shows on an enlarged scale a front view of one of the rollers shown in FIG. 7.

Referring to FIG. 9, there is shown a front view of the roller 122 shown in FIG. 7. The roller includes 14 forming discs 148 fixedly mounted axially adjacent each other on the arbor 128 in three axial regions 162, 164 and 166 respectively. Four cutting discs 148 are provided in each of the axial regions 162 and 166. The diameters of the discs in these regions are different and the arrangement is such that the configuration of the forming discs in each of the regions 162 and 166 taper in axially opposite directions from a dimension 168 to a dimension 170. The forming discs 148 in the region 164 have rounded peripheries and all have the same diameter 168. It is desirable that the diameter 168 and 170 of the discs 148 be as small as possible to minimise flexing of the discs during generation of a fin. The total axial length 172 of the roller 122 is smaller than the diameter 168 of the forming discs 148. In one specific arrangement the dimensions of the roller 122 may be as follows:

162 and 166=9.6 mm
164=14.8 mm
172=34 mm
168=82 mm to 85 mm.
170=76 mm.

The diameter of the fin stock 144 may be 25.4 mm.

The axial spacing between the discs 148 may vary and may further vary from the region 164 to the regions 162 and 166.

FIG. 9 only shows the roller 122, but the rollers 124 and 126 shown in FIG. 7 are of a similar configuration. The different rollers are offset axially from each other.

Figure 10:
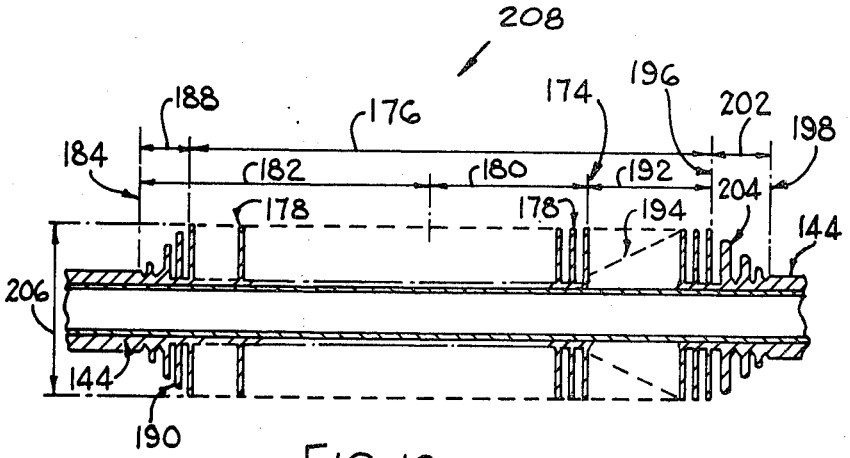
FIG. 10 shows a longitudinal sectional view, partly fragmentary, of finned tubing manufactured in accordance with the method of the invention.

Referring now to FIG. 10, the generation of a fin from the fin stock 144 is illustrated. The apparatus 120 shown in FIG. 7 will also be referred to. The rollers 122, 124 and 126 are rotated in a counterclockwise direction and are closed in the direction of arrows 156, 158 and 160 around the fin stock 144 at the point 174 on the fin stock intermediate the ends of the fin stock. The point 174 is near the centre of the axial length 176 of fin to be formed from the fin stock or slightly off centre as shown in FIG. 10. The rollers 122, 124 and 126 are closed around the fin stock 144 so as to gradually penetrate into the fin stock 144. The closing of the rollers is carefully controlled in one of two ways. In a first method the rollers are closed in stages. During the first stage of closing the rollers are rotated in a counterclockwise direction for a few revolutions, say about five, so that the fin stock 144 is contra-rotated a few revolutions which will exceed five due to the diameter of the fin stock being smaller than the diameter of the discs 148. The rotation of the rollers is then arrested and without any time lag, ie almost instantaneously, direction of rotation of the rollers is reversed and the rollers are closed a little more and are rotated a further few revolutions so that the fin stock 144 is thereby rotated in a reverse direction. The direction of rotation of the rollers 122, 124 and 126 is then again reversed and the rollers are closed a little more around the fin stock and are again rotated so that the fin stock 144 is rotated for a few revolutions. The oscillating reversal of the direction of rotation of the rollers is carefully controlled, and could be from about 1 to 10 revolutions. The rollers are thereby caused to make a number of axial passes over the same axial region of the fin stock with the discs 148 gradually penetrating deeper into the fin stock 144. This sequence of operation is continued until the fin 178 is fully developed over a short axial region 180 adjacent the starting point 174. The rollers are maintained in a closed position and are then rotated without reversing direction to traverse the fin stock over the region 180 to form the fin 178 over the entire region 182 up to the point 184 where the fin terminates. The rotation of the rollers is then arrested. Due to the tapering configuration 186 of the forming discs 148 in the regions 162 and 166 on the roller 122 as shown in FIG. 9, and similar tapering regions on the rollers 124 and 126, and due to arresting the rotation of the rollers, a tapering finned region 188 is formed at the end of the finned region 182 adjacent the terminal point 184. In the region 188 the fin 190 is under developed.

In an alternative method the closing of the rollers 122, 124 and 126 around the fin stock 144 may be effected continuously. The rotation of the rollers is oscillatingly reversed during the continuous closing of the rollers in the same manner as described above for the closing of the rollers in stages.

It will be understood that due to the tracking of the discs 148 of the rollers 122, 124 and 126 in the same groove or fin generated from the fin stock 144, each groove or fin is generated by being sequentially tracked by the discs in all three rollers. Thus, for example, as there are six discs in the region 164 of each of the rollers, each fin is generated by sequential tracking of $3\times6=18$ discs 148.

During the next stage of the fin forming operation the rollers 122, 124 and 126 are rotated in an opposite direction and are re-engaged with the finned region 182 via the under developed fin 190 in the tapering finned region 188. Due to the engagement of the forming discs 148 with the fins 190 and 178, and due to the helical shape of the fin 178, 190, and due to the rotation of the rollers 122, 124 and 126, the fin 178, 190, together with the fin stock 144, is axially displaced with respect to the rollers 122, 124 and 126. When the rollers reach the starting point 174, the rollers are closed in the direction of arrows 156, 158 and 160 and the rollers are rotated for a few revolutions to penetrate into the fin stock in the region 192 to thereby form a fin which is a continuation of the fin 178 beyond the starting point 174. During the closing of the rollers 122, 124 and 126 the rotation of the rollers is continued for a few revolutions and the rotation of the rollers is then reversed for a few revolutions. During the reversing of the rotation of the rollers the rollers are gradually closed more firmly around the fin stock 144 so as to penetrate deeper into the fin stock and thus build up the fin to a greater height. The oscillating reversal of the direction of rotation of the rollers in the manner indicated above is continued until a transition of the fin from the region 180 past the starting point 174 to the region 192 has been achieved with the fin being built up gradually as indicated by the chain dot line 194 until the full height of the fin 178 is reached at 196. The rollers are then maintained closed around the fin stock 144 and rotation in the same direction is maintained so that the fin stock is traversed up to 198. From 174 to 196 a fully developed fin 178 is formed and from 196 to 198 over the region 202 an under developed fin 204 is formed similar to the fin 190 which tapers axially in a direction opposite to the fin 190 in the region 188.

The length of the tapering regions 188 and 202 in which the fins 190 and 204 are developed to reach the full height of the fin 170 is in each case from 0.4 to 0.75 and more specifically from 0.50 0.60 of the outside diameter 206 of the fully developed fin 178.

The overall length of the finned tubing 208 shown in FIG. 10 formed in accordance with the method described above, is therefore the axial length 176 in which the fin 178 is fully developed, plus the two axial regions 188 and 202 which are tapering regions over which the fins 190 and 204 are under developed.

Figure 11:
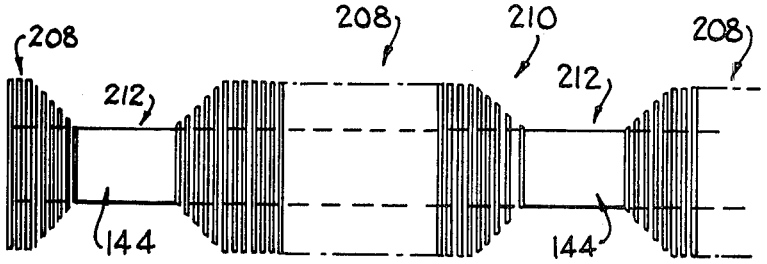
FIG. 11 shows a side view of finned tubing formed in accordance with the method of the invention and including finned and finless regions.

Referring to FIG. 11, reference numeral 210 indicates in general a finned tubing comprising finned regions 208 interposed between finless regions 212 on the fin stock 144.

Figure 12:
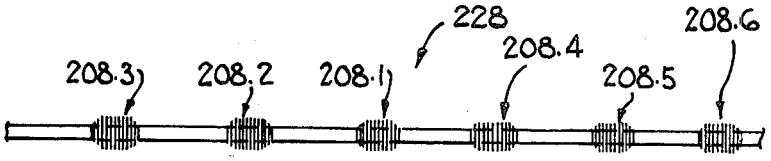
FIG. 12 shows the sequence of forming axially spaced finned regions on a tube.

FIG. 12 shows diagrammatically the sequence of forming finned regions 208 as shown in FIGS. 10 and 11 in a long finned tube 228 which is several meters in length. In order not to impose too high an axial drag on the fin during generation of the fin, the sequence of fin generation is as indicated, namely 208.1 (which is near the centre of the tube 228), 208.2 and 208.3. The machining is then stopped, the tube 208 is reversed and the sequence of fin generation then followed is 208.4, 208.5 and 208.6.

Finned tubing in accordance with the invention is suitable for heat exchanging of fluids ie gases and liquids, for example in uranium enrichment.

I claim:

1. A method of manufacturing finned tubing from tubular metal fin stock which includes providing the fin stock in axially continuous form and providing on the fin stock at least two finned regions and at least one finless region interposed between two finned regions, the method including employing a plurality of rollers drivably mounted on arbors spaced about the tubular fin stock, each of the rollers including a plurality of axially arranged forming discs and the rotational axis of each arbor intersecting the longitudinal axis of the fin stock, the method including effecting relative rotation one direction of the discs with respect to the tubular fin stock, bringing the discs into rolling contact with the tubular fin stock at a position intermediate the ends of the fin stock and developing a helical fin extending over a finite axial distance of the fin stock, arresting the rotation of the discs and reversing the direction of rotation of the forming discs so that the axial displacement of the fin stock is thereby reversed, and the method further including developing the fin in a finned region to its full height over an axial distance of the fin stock equal to from 0.40 to 0.75 of the outside diameter of the fully developed fin.

2. A method as claimed in claim 1, which includes developing the fin in a finned region to its full height over an axial distance of the fin stock equal to from 0.50 to 0.60 of the outside diameter of the fully developed fin.

3. A method as claimed in claim 1, which includes maintaining the reverse axial displacement of the fin stock until the axial starting point of the fin generation is reached and then continuing the rotation of the forming discs and the axial displacement of the fin stock past the starting point, and generating the fin over a finite axial distance of the fin stock extending beyond the starting point.

4. A method as claimed in claim 1, which includes controlling the bringing of the forming discs into rolling contact with the tubular fin stock during oscillating reversal of the direction of rotation of the forming discs.

5. A method as claimed in claim 4, in which the method of control includes closing the arbors continuously on the fin stock during oscillating reversal of direction of rotation of the forming discs.

6. A method as claimed in claim 4, in which the method of control includes closing the arbors in stages on the fin stock during oscillating reversal of rotation of the forming discs.

7. A method as claimed in claim 1, which includes reversing the direction of rotation of the forming discs substantially instantaneously.

8. A method as claimed in claim 1, which includes effecting relative rotation between the forming discs and the fin stock by drivingly rotating the forming discs and imparting contra-rotation to the fin stock due to frictional engagement of the discs with the fin stock.

9. A method as claimed in claim 1, which includes starting the forming of the finned regions approximately in the axial central region of the fin stock and then forming further finned regions from the central region outwardly towards the end regions of the tube.

10. A method as claimed in claim 1, in which the forming discs on the different arbors track each other and engage the fin to a different extent to facilitate rapid development of the fin to its full height.

11. A method as claimed in claim 10, in which one forming disc on one arbor engages one third of the height of the fin, the tracking forming disc on a second arbor engages a further third of the height of a fin, and a tracking forming disc on a third arbor engages the final third of the height of the fin.

12. A method as claimed in claim 1, which includes bringing the forming discs into rolling contact with the fin stock by closing the forming discs around the fin stock by moving them in a radial direction towards the fin stock, forming an axial length of fin by rotation of the forming discs, arresting the rotation of the discs to terminate the fin, reversing the direction of rotation of the forming discs substantially instantaneously to thereby displace the fin stock in an opposite axial direction, and when the forming discs reach the axial starting point of the formation of the fin, closing the forming discs further around the fin stock to thereby develop the fin in an axially opposite direction from the starting direction.

13. A method as claimed in claim 12, which includes effecting axial transition from the finned to the under developed finned region by oscillatingly reversing the rotation of the discs a few revolutions.

14. A method as claimed in claim 13, which includes continuing the fin formation for a desired axial length and releasing the discs from the fin stock to thereby terminate the fin.

15. A method as claimed in claim 1, in which the rotational axes of the arbors intersect the axis of the fin stock at different angles.

16. Apparatus for manufacturing finned tubing from tubular metal fin stock in which the tubing has finned and finless regions, the apparatus including three rotatably drivable arbors, and a plurality of axially arranged forming discs mounted on each arbor to be rotatably drivable by the arbors, each forming disc on each arbor being arranged to track an associated disc on each other arbor, whereby the associated discs on the respective arbors form tracking groups of discs, and wherein the tracking groups are axially spaced, the forming discs in each tracking group are of different diameters respectively, and the forming discs on each arbor are provided in three axial regions, namely a first axial region including discs of different diameters with the axially extending profile of the discs tapering axially, a second axial region similar to the first axial region including discs of different diameters but with the axially extending profile of the discs tapering axially in an opposite direction, and a third axial region of discs of equal diameter interposed between the first and the second axial regions.

17. Apparatus according to claim 16, in which the diameters of the tracking forming discs in each tracking group vary in the proportion 1 to 1.1 to 1.2.

18. Apparatus according to claim 16, in which the axis of each arbor intersects the longitudinal axis of the fin stock.

19. Apparatus according to claim 18, in which the rotational axes of the arbors intersect the longitudinal axis of the fin stock at different angles.

20. Apparatus according to claim 19, in which the angle of intersection between the rotational axis of each arbor and the longitudinal axis of the fin stock is between 3 degrees and 7 degrees.

21. Apparatus according to claim 20, in which the angles of intersection between the rotational axes of the arbors and the longitudinal axis of the fin stock are 3 degrees for one arbor, 4 degrees for another arbor and 6 degrees for the third arbor.

22. Apparatus according to claim 16, in which the axial length of the set of forming discs on each arbor is shorter than the overall diameter of the largest discs in each set.

23. Apparatus according to claim 22, in which the overall diameter of the largest discs on each arbor to the length of the set of discs is in the ratio of from 2.2 to 1 to 2.6 to 1.

24. Apparatus according to claim 16, in which the first and the second axial regions each include four forming discs and the third axial region includes six forming discs.

25. Apparatus according to claim 16, in which the axial spacing between the forming discs in the axially tapering first and second regions is different from the axial spacing between the forming discs in the third axial region.

26. Apparatus according to claim 16, in which the direction of rotation of the arbors is reversible.

* * * * *